US010954609B2

(12) United States Patent
Aronson et al.

(10) Patent No.: US 10,954,609 B2
(45) Date of Patent: Mar. 23, 2021

(54) YARN FROM POLYMERS HAVING DIFFERENT DECOMPOSITION TEMPERATURES AND PROCESS FOR FORMING SAME

(71) Applicant: DUPONT SAFETY & CONSTRUCTION, INC., Wilmington, DE (US)

(72) Inventors: Mark T. Aronson, Midlothian, VA (US); Alicia Marie Castagna, Framingham, MA (US); Joseph D Trentacosta, Wilmington, DE (US); Paul Douglas Stull, Wilmington, DE (US)

(73) Assignee: DUPONT SAFETY & CONSTRUCTION, INC., Wilmington, DE (US)

( * ) Notice: Subject to any disclaimer, the term of this patent is extended or adjusted under 35 U.S.C. 154(b) by 146 days.

(21) Appl. No.: 15/209,047

(22) Filed: Jul. 13, 2016

(65) Prior Publication Data

US 2017/0029983 A1 Feb. 2, 2017

Related U.S. Application Data

(60) Provisional application No. 62/198,411, filed on Jul. 29, 2015.

(51) Int. Cl.
*D01F 8/08* (2006.01)
*D01D 5/34* (2006.01)
(Continued)

(52) U.S. Cl.
CPC ..... *D01F 8/08* (2013.01); *D01D 5/04* (2013.01); *D01D 5/34* (2013.01); *D01F 8/12* (2013.01);
(Continued)

(58) Field of Classification Search
CPC .. D01F 8/08; D01F 8/12; D02G 3/045; D02G 3/047
(Continued)

(56) References Cited

U.S. PATENT DOCUMENTS 2,936,482 A 5/1960 Kilian
3,038,239 A 6/1962 Moulds
(Continued)

FOREIGN PATENT DOCUMENTS

GB 1409258 A * 10/1975 ..... D01F 8/08
JP 2005256231 A 9/2005

OTHER PUBLICATIONS

How Nomex Works, ExplainThatStuff. http://www.explainthatstuff.com/nomex.html, retrieved Jul. 2, 2012, Wayback Machine.*
(Continued)

*Primary Examiner* — Jennifer A Gillett

(57) ABSTRACT

This invention relates to a yarn, and a process for making the yarn, the yarn comprising a plurality of spun filaments having a distinct, continuous, uniform-density sheath of a first polymer surrounding a distinct, continuous core of a second polymer; the first polymer further having a thermal decomposition temperature at least 50 degrees Celsius lower than the thermal decomposition temperature of the second polymer.

11 Claims, 4 Drawing Sheets

(51) Int. Cl.
*D01D 5/04* (2006.01)
*D01F 8/12* (2006.01)
*D02G 3/04* (2006.01)
*D01D 5/253* (2006.01)

(52) U.S. Cl.
CPC ..... *D02G 3/045* (2013.01); *D02G 3/047* (2013.01); *D01D 5/253* (2013.01)

(58) Field of Classification Search
USPC ..... 428/373; 442/189, 199, 311, 361
See application file for complete search history.

(56) References Cited

U.S. PATENT DOCUMENTS 3,047,455 A 7/1962 Holmes et al.
3,063,966 A 11/1962 Kwolek et al.
3,094,511 A 6/1963 Hill et al.
3,193,602 A 7/1965 Leonard et al.
3,227,793 A 1/1966 Cipriani
3,287,324 A 11/1966 Sweeny
3,354,127 A 11/1967 Hill, Jr. et al.
3,414,645 A 12/1968 Morgan, Jr.
3,541,198 A 11/1970 Ueda et al.
3,673,143 A 6/1972 Bair et al.
3,748,302 A 7/1973 Jones
3,819,587 A 6/1974 Kwoleck
3,869,429 A 3/1975 Blades
4,172,938 A 10/1979 Mera et al.
4,224,271 A 9/1980 Tse
4,309,476 A 1/1982 Nakamura et al.
4,457,973 A * 7/1984 Matsui ..... A46D 1/00 428/372
4,958,485 A * 9/1990 Montgomery ..... D02G 3/367 428/377
4,996,099 A * 2/1991 Cooke ..... B32B 5/18 428/373
5,208,105 A 5/1993 Ichibori et al.
5,264,531 A * 11/1993 Fukui ..... D01F 8/08 526/245
5,505,889 A 4/1996 Davies
5,506,042 A 4/1996 Ichibori et al.
5,902,530 A * 5/1999 Jorkasky ..... D01F 8/08 264/78
7,771,636 B2 8/2010 Headinger et al.
7,771,637 B2 8/2010 Headinger et al.
7,771,638 B2 8/2010 Headinger et al.
7,780,889 B2 8/2010 Headinger et al.
7,998,575 B2 8/2011 Headinger et al.
2005/0287364 A1* 12/2005 Zhu ..... D02G 3/047 428/357
2008/0057807 A1* 3/2008 Tutterow ..... A41D 31/0022 442/1
2009/0126749 A1 5/2009 Yutaka et al.
2009/0162655 A1* 6/2009 Headinger ..... D01D 5/04 428/394
2011/0274903 A1* 11/2011 Stuart ..... A63B 21/0607 428/219
2015/0119511 A1 4/2015 Liu-Seung

OTHER PUBLICATIONS

Ellis, Bryan Smith, Ray. (2009). Polymers—A Property Database (2nd Edition)—Modacrylic fibres. Taylor & Francis.*
Wilkie, Charles A. Morgan, Alexander B.. (2010). Fire Retardancy of Polymeric Materials (2nd Edition)—2.3.5 High Temperature-Resistant Polymers. Taylor & Francis.*
Celanese Acetate, Complete Textile Glossary, Celanese Acetate LLC, 2001.*
Gertsen, J, et. all, Kinetic Study of the Thermal Decomposition of Polypropylene, Oil Shale, and Their Mixture, Fuel 79 (200) p. 1679-1686.*
Technical Guide Kevlar Aramid Flber, DuPont, http://www.dupont.com/content/dam/dupont/products-and-services/fabrics-fibers-and, retrieved from wyabck machine, Mar. 15, 2015.*
Gao, Xi-yin, et. al., Melt-Processable Acrylonitrile-Methyl Acrylate Copolymers and Melt-Spub Fibers containing MicroPCMs, Journal of Material Science (2009) 44:5877-5884.*
The Complete Textile Glossary, Celanese Acetate LLC, 2001.*
Ellis, Bryan Smith Ray. (2009). Polymers—A Property Database (2nd Edition). Taylor & Francis.*
Black et al. Man-Made Fibers—Science and Technology, vol. 2, Section titled Fiber-Forming Aromatic Polyamides, p. 297, W. Black Interscience Publishers, 1968.
Cullis, C.F. et al., :The significance of thermoanalytical measurements in the assessment of polymer flammability, Polymer, Elsevier Science Publishers B.V. GB, vol. 24, No. 7, Jul. 1, 1983, pp. 834-840, XP025437399, ISSN: 0032-3861(83)90200-8 [retrieved on Jul. 1, 1983] tables 1, 3, 4.
Peterson, J.D. et al., "Kinetics of the Thermal and Thermo-Oxidative Degradation of Polystyrene, Polyethylene and Poly(propylene)", Macromolecular Chemistry and Physics, vol. 202, No. 6, Mar. 1, 2001, pp. 775-784, XP055301935, DE, ISSN: 1022-1352, DOI: 10.1003/1521-3935(Mar. 1, 2001)202:6<775::AID-MACP775>3.0.CO;2-G figures 1, 2, 3.
International Search Report.

* cited by examiner

YARN FROM POLYMERS HAVING DIFFERENT DECOMPOSITION TEMPERATURES AND PROCESS FOR FORMING SAME

BACKGROUND OF INVENTION

Field of the Invention. This invention relates to yarns of filaments comprising at least two different polymers, each filament having a distinct continuous sheath of a first polymer and a distinct continuous core of a second polymer, wherein the polymers have widely different thermal decomposition temperatures, and methods of making the yarns.

Description of Related Art. U.S. Pat. No. 4,224,271 to Tse discloses wet-spinning a polymer composition that consists of an admixture of polyacrylonitrile and an aromatic polyamide for use in the manufacture of textile filaments, fibers, yarns, and/or fabrics.

U.S. Pat. No. 4,309,476 to Nakamura et al. discloses a core-in-sheath type aromatic polyamide fiber having satisfactory dyeing properties made from a single aromatic polyamide material. When the core-in-sheath fiber is dyed with acid dyes, only the sheath portion is colored. U.S. Pat. No. 4,398,995 to Sasaki et al. discloses the use of the fiber of Nakamura in a paper.

U.S. Pat. No. 3,038,239 to Moulds discloses improved composite filaments that have crimp reversibility. The filaments have at least two hydrophobic polymers in eccentric relationship, wherein one of the hydrophobic polymers further contains mixed therewith a minor amount of polymer having a high water absorption rate.

In some fiber applications a bicomponent fiber is desired; however, solution spinning of yarns having good quality sheath-core bicomponent filaments creates temperature processing issues when one of the polymers happens to have a much lower decomposition temperature than the second polymer and the filaments are spun at high temperatures.

Further, in order to form stable spinning solutions of certain polymers, a certain degree of inorganic salt must be added to the polymer solution. It is believed this inorganic salt associates with and forms a chemical complex with the solvent and the polymer, which helps maintain the polymer in solution; but this chemical complex also hinders the later removal of the solvent from the spun filaments. Other polymers do not require the addition of an inorganic salt to form stable spinning solutions.

So in addition to desiring useful bicomponent filament yarns made from polymers having widely differing thermal decomposition temperatures, methods are needed for spinning useable high quality sheath-core filaments made from two different polymer solutions, wherein the first polymer is readily soluble in a solvent and forms a stable-for-spinning first polymer solution without the addition of an inorganic salt and the second polymer requires a certain amount of inorganic salt be added to the solvent to make the second polymer soluble in the solvent and form a stable-for-spinning second polymer solution.

BRIEF SUMMARY OF THE INVENTION

This invention relates to a yarn comprising a plurality of filaments, each of the filaments having a distinct, continuous, uniform-density sheath of a first polymer and a distinct, continuous core of a second polymer, with the sheath surrounding the core; wherein the filaments are made by extruding a first polymer solution containing the first polymer in a solvent with a second polymer solution containing the second polymer in the same solvent; and additionally, the first polymer solution being salt-free and the second polymer solution including at least 4 percent inorganic salt by weight, based on the amount of the salt, the second polymer, and the solvent in the second solution; the first polymer further having a thermal decomposition temperature at least 50 degrees Celsius lower than the thermal decomposition temperature of the second polymer, preferably at least 75 degrees Celsius lower than the thermal decomposition temperature of the second polymer. In some preferred embodiments, the first polymer inherently has a limiting oxygen index (LOI) of greater than 21, or is provided with additives that increase the LOI of the first polymer to an LOI of greater than 21, and the second polymer inherently has an limiting oxygen index (LOI) of greater than 24. In some preferred embodiments, the yarn includes sheath-core filaments wherein the sheath is a polyacrylonitrile and the core is an aramid. In some most preferred embodiments the yarn includes sheath-core filaments wherein the sheath is a modacrylic and the core is a poly(meta-phenylene isophthalamide).

This invention further relates to a process for forming a yarn comprising filaments, each of the filaments comprising a distinct, continuous uniform-density sheath of a first polymer and a distinct, continuous core of a second polymer, with the sheath surrounding the core; the first polymer having a thermal decomposition temperature at least 50 degrees Celsius lower than a thermal decomposition temperature of the second polymer, the process comprising the steps of:

a) forming a first polymer solution containing the first polymer in a solvent and a second polymer solution containing the second polymer in the same solvent;
   the first polymer solution being salt-free and the second polymer solution including at least 4 percent inorganic salt by weight, based on the amount of the salt, the second polymer, and solvent in the second solution; and
b) providing a spinneret assembly having separate inlets for the first polymer solution and the second polymer solution and a plurality of exit capillaries for spinning dope filaments;
c) forming a plurality of dope filaments having a sheath of the first polymer solution and a core of the second polymer solution by extruding through the exit capillaries a plurality of conjoined streams of the first and the second solutions into a spin cell,
d) contacting the dope filaments solely with heated gas in the spin cell to remove solvent from the dope filaments to form reduced solvent filaments, the heated gas having a temperature such that the dope filaments remain below the thermal decomposition temperature of the first polymer in the spin cell;
e) quenching the reduced solvent filaments with an aqueous liquid to cool the filaments, forming a yarn of polymer filaments; and
f) further extracting solvent from the yarn of polymer filaments.

DETAILED DESCRIPTION OF THE INVENTION

Figure 1:
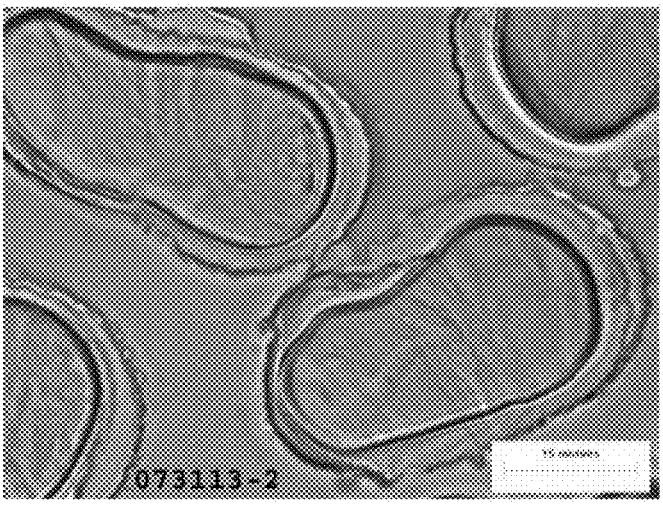
FIG. 1 is an optical microscope image of the cross section of high quality sheath-core bicomponent filaments each having a sheath of modacrylic polymer and a solid dense poly(metaphenylene isophthalamide) polymer center.

This invention relates to a yarn comprising a plurality of filaments having a distinct, continuous, uniform-density sheath of a first polymer surrounding a distinct, continuous core of a second polymer, wherein the filaments are made by extruding (spinning) a first polymer solution containing the first polymer in a solvent with a second polymer solution containing the second polymer in the same solvent. In some preferred embodiments the filaments are dry spun. The first polymer solution is salt-free and the second polymer solution includes at least 4 percent inorganic salt by weight, based on the amount of the salt, the second polymer, and the solvent in the second solution, to maintain the second polymer in solution. Further, the first polymer has a thermal decomposition temperature at least 50 degrees Celsius lower than the thermal decomposition temperature of the second polymer. In some embodiments the thermal decomposition temperature of the first polymer is at least 75 degrees Celsius lower than the thermal decomposition temperature of the second polymer. In some preferred embodiments the first polymer inherently has a limiting oxygen index (LOI) of greater than 21, or is provided with additives that increase the LOI of the first polymer to an LOI of greater than 21, the second polymer inherently having an LOI of greater than 24.

Remarkably, the combination of first polymer and second polymer can be spun into useful high quality bicomponent sheath-core filaments at temperatures that, when used to make single component filaments solely from the second polymer, do not produce high-quality filaments. In addition, high quality filaments are possible despite major differences in the solvent systems in the two polymer solutions.

In the dry spinning of single polymer filaments spun from homopolymer poly(metaphenylene isophthalamide) (MPD-I) solutions, wherein the polymer solution is obtained by the solution-based reaction of metaphenylene diamine with isophthaloyl chloride, the polymerization reaction produces hydrochloric acid (HCl) as a by-product. This HCl can be neutralized by the addition of a basic compound to form a salt. Fibers are then spun from this solution of polymer, salt, and solvent. Unfortunately, removal of the solvent from the dope filaments spun from the combination of polymer, salt, and solvent is complicated by what is believed to be a chemical complex that forms between the salt and solvent in the dope filaments. Therefore for practical commercial production via dry spinning the heated gaseous atmosphere in the spin cell has typically utilized very high temperatures to provide adequate driving force to remove solvent from the dope filaments.

As taught in U.S. Pat. Nos. 7,771,636; 7,771,637; 7,771,638; 7,780,889; & 7,998,575 the dry spinning of MPD-I homopolymer filaments is typically conducted in a spinning cell having a heated gaseous atmosphere wherein the heated gas is provided to the spin cell at a temperature of above about 250 degrees Celsius, preferably around 300 degrees Celsius or greater. It is believed that given enough driving force and residence time in the spinning cell, adequate amounts of solvent will be removed, resulting in filaments having solid, dense centers and an essentially non-round or oblong shape that has been described variously as being bean-shaped, cocoon-shaped, and/or dog-bone-shaped. Useful and good quality yarns having many filaments may have a variety of these various cross sections, all with dense solid centers.

If the removal of the solvent from the filaments is not adequately managed, various defects in the filaments can arise, including large areas of voids or less dense areas in the centers of the filaments believed to be caused by trapped solvent; or radial voids or cracks in the filaments from too rapid expulsion of the solvent from the filaments.

The inventors of the claimed yarn have overcome two significant technical hurdles. First, they found that surprisingly, a yarn having a plurality of sheath-core filaments, each having a distinct continuous uniform-density sheath and made from the a first polymer solution that is salt-free, can be dry-spun in combination with a distinct, continuous core formed from a second polymer solution including at least 4 percent inorganic salt by weight. The use of a salt-free polymer solution on the sheath means that the solvent in the sheath will be rapidly evolved in the spin cell since it has no chemical complex retaining the solvent in the sheath. Therefore, intuitively, a thick skin would form on the surface of the filament that would undesirably further trap solvent in the core, which because it is spun from a salt-containing polymer solution is already difficult to remove from the filament.

Second, they found that even if the two different desired polymers have thermal decomposition temperatures that differ significantly, yarns having surprisingly high quality filaments can be spun if the heated gaseous atmosphere in the spin cell is maintained such that the filament temperatures in the spin cell remain below the lower of the thermal decomposition temperature of the polymers being spun.

Preferably, high quality filaments are spun. By high quality filaments it is meant such yarns have filaments that have solid, dense centers without large areas of voids or less dense areas in the centers, or radial voids or cracks.

The filaments are preferably made by dry-spinning a first polymer solution containing the first polymer in a solvent and a second polymer solution containing the second polymer in the same solvent. Additionally, the first polymer is readily soluble in a solvent and forms a stable polymer spinning solution without the addition of an inorganic salt. In other words, the first polymer solution is salt-free or free from salt. The second polymer requires a certain amount of inorganic salt be added to the solvent to not only make the second polymer soluble in the solvent, but to form a stable polymer spinning solution. Further, the second polymer solution includes at least 4 percent inorganic salt by weight, based on the amount of the salt, the second polymer and the solvent in the second solution, to maintain the second polymer in solution. In some embodiments the solution includes at least 7 weight percent inorganic salt.

The filaments have a distinct, continuous, uniform-density sheath of a first polymer surrounding a distinct, continuous core of a second polymer, By "distinct" it is meant that the first and second polymers are appreciably unmixed in the filament, and there is a distinct visible boundary between the two polymer regions that can be seen by visual inspection under suitable magnification using an optical or electron microscope. By "continuous" is meant, in the case of the sheath of the sheath-core filament, that the sheath of the first polymer completely radially surrounds the core of the second polymer, and that the coverage of the core of the second polymer by the first polymer sheath is substantially continuous linearly along the length of the filament; or in the case of the core of the sheath-core filament, that the core of second polymer is substantially continuous linearly along the length of the filament. By the phrase "uniform-density sheath" it is meant that by visual inspection under suitable magnification using an optical or electron microscope the filament cross section shows the sheath to be generally solid and to be free of objectionable porosity. In preferred embodiments, a uniform-density core is also present in the filament. By "uniform-density core" it is meant that visual inspection under suitable magnification using an optical or electron microscope the filament cross section also shows the filaments to have solid, dense centers and to be free of objectionable porosity and voids. In other words, in some preferred embodiments, the continuous core of second polymer has a substantially solid cross section and uniform density. Further, in some embodiments the filaments are oval, oblong, bean-shaped, cocoon-shaped, dog-bone-shaped, or a mixture of these.

There is no requirement that the core be centered in the sheath, or that the thickness of the sheath or core be the same for each filament, since each filament can have slight differences in shape due to the inability to control all forces on the filaments during formation. However, the relative amount of the polymers/polymer solutions that are used can provide average dimensions.

Figure 3:
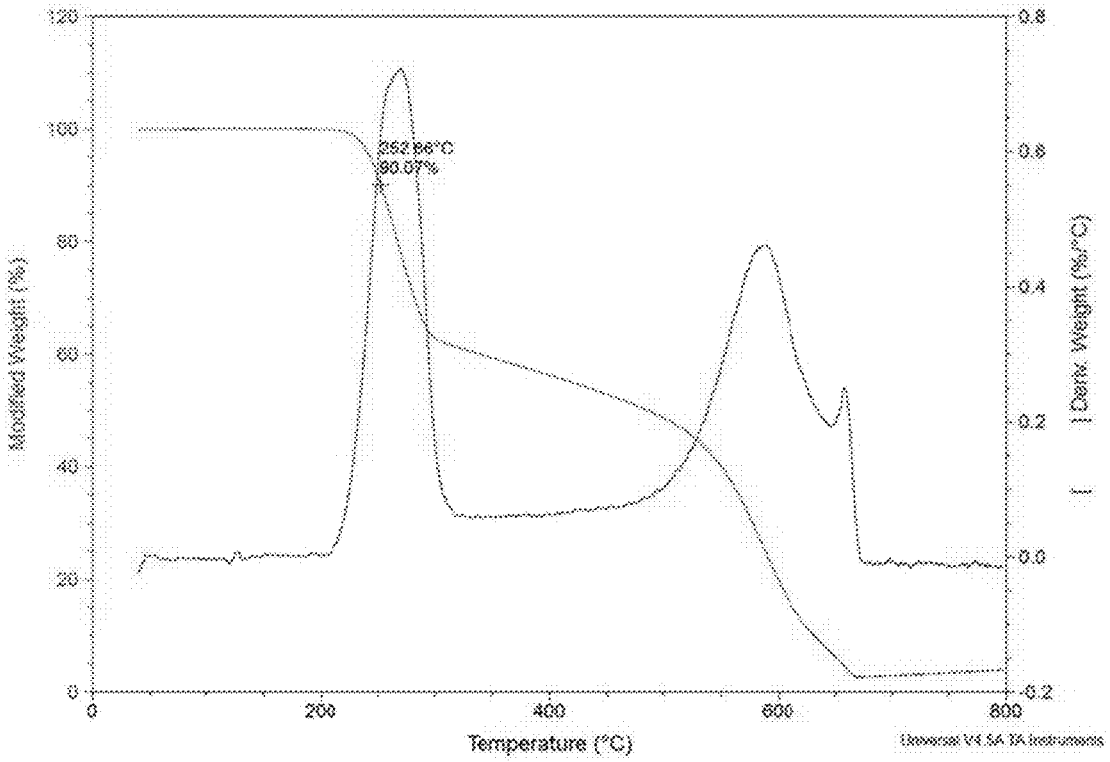
FIG. 3 is a scan made by a thermo-gravimetric analyzer (TGA) for modacrylic polymer illustrating how the thermal decomposition temperature can be determined.
Figure 4:
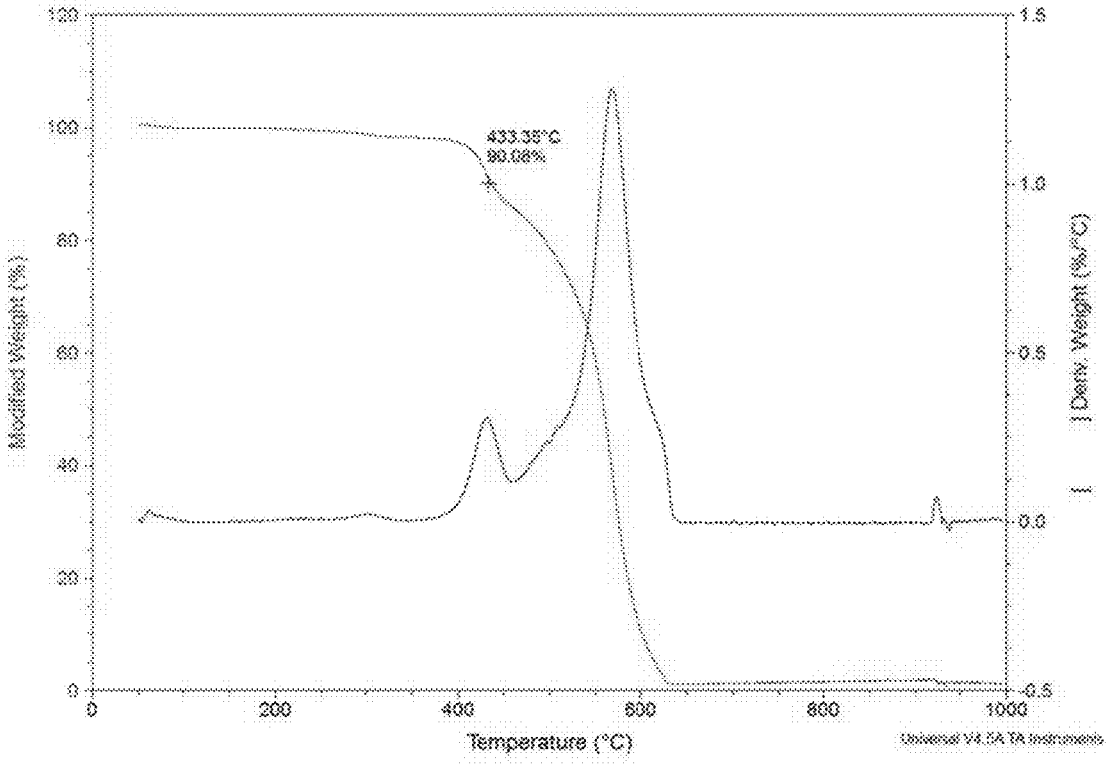
FIG. 4 is a TGA scan of poly (metaphenylene isophthalamide).
Figure 5:
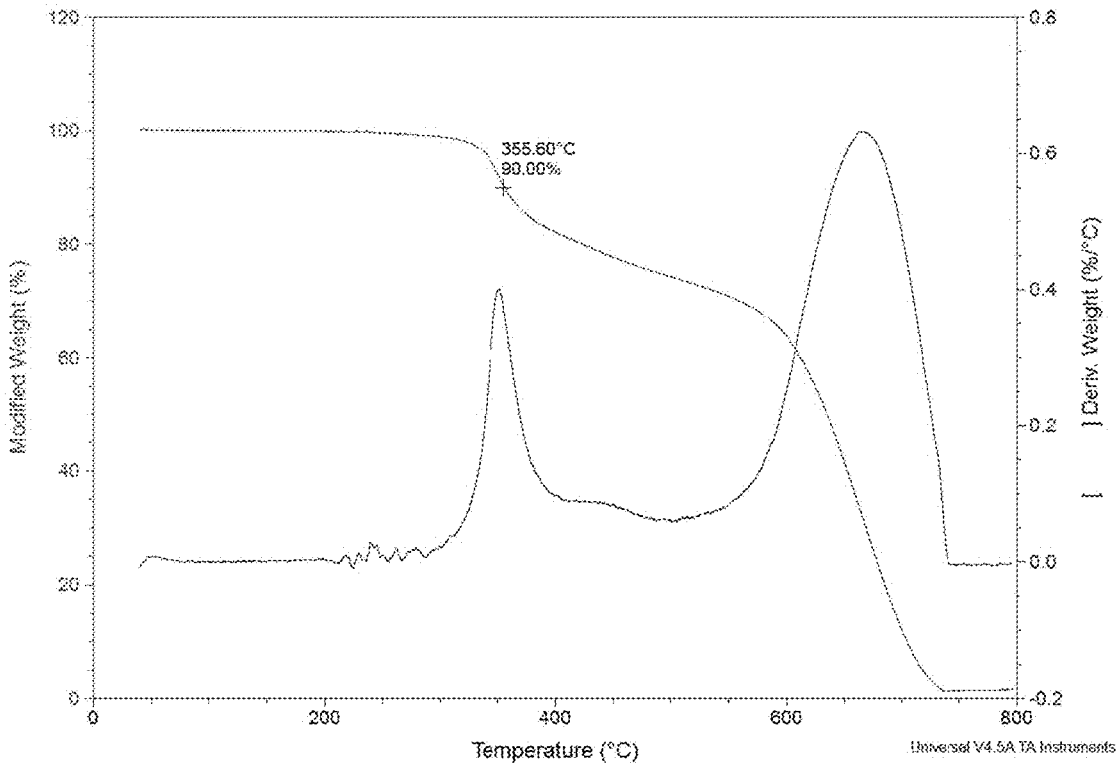
FIG. 5 is a TGA scan of an acrylic copolymer.

In each filament, the first polymer in the sheath has a thermal decomposition temperature at least 50 degrees Celsius lower than the thermal decomposition temperature of the second polymer in the core; preferably the thermal decomposition temperature of the first polymer is at least 75 degrees Celsius lower than the thermal decomposition temperature of the second polymer. The thermal decomposition temperature of the polymers is determined by use of a thermo-gravimetric analyzer (TGA) equipped with an a Fourier Transform Infrared (FTIR) spectrometer to analyze the composition of gases evolved from the sample as it is heated from room temperature to greater than 500° C. at a heating rate of 10 degrees Celsius per minute. The TGA determines the decomposition temperature and the FTIR confirms that the weight loss is associated with decomposition products and not water or solvent. As used herein, the polymer thermal decomposition temperature is that temperature where at least 10% of the weight of the polymer is lost due to actual thermal decomposition of the polymer as shown by the TGA scan. FIGS. 3, 4, & 5 are scans of the loss in weight per degree temperature made by a thermo-gravimetric analyzer for filament samples of three different polymers illustrating how the thermal decomposition temperature can be determined. At a 10 percent loss in weight, the analyzer software can identify the decomposition temperature as shown by the (+) on the scan. The decomposition temperatures of these polymer filaments, which are modacrylic, poly(metaphenylene isophthalamide) and an acrylic copolymer with vinyl acetate, respectively, were determined to be (rounding to the nearest degree) 253, 433, and 356 degrees Celsius.

The spinning process includes the forming of at least a first solution of a first polymer and a first solvent, wherein the first polymer inherently has a limiting oxygen index (LOI) of greater than 21, or is provided with additives that increase the LOI of the first polymer to greater than 21; and a second solution of a second polymer and a second solvent, the second polymer inherently having an LOI of greater than 24. In some preferred embodiments, the sheath of first polymer contains 10 to 30 weight percent of a flame retardant additive, based on the amount of first polymer and the flame retardant additive. In some preferred embodiments the spinning process is a dry spinning process.

The word polymer is used herein is meant to include both homopolymer and copolymer.

In one embodiment, the first polymer is a poly (acrylonitrile) polymer, which has a thermal decomposition temperature as defined herein of generally less than about 360° C. and preferably below 300° C.

Poly (acrylonitrile) polymer, in some embodiments, includes at least 85 wt % acrylonitrile units. An acrylonitrile unit is —(CH2-CHCN)—. In addition to the 85% by weight or more of acrylonitrile, the polymer can have 15% by weight or less of an ethylenic monomer copolymerizable with acrylonitrile and mixtures of two or more of these acrylic polymers. Examples of the ethylenic monomer copolymerizable with acrylonitrile include acrylic acid, methacrylic acid and esters thereof (methyl acrylate, ethyl acrylate, methyl methacrylate, ethyl methacrylate, etc.), vinyl acetate, vinyl chloride, vinylidene chloride, acrylamide, methacrylamide, methacrylonitrile, allyl sulfonic acid, methane sulfonic acid and styrene sulfonic acid. One illustrative method of making acrylic polymers and fibers is disclosed in U.S. Pat. No. 3,047,455.

If the polyacrylonitrile polymer has a Limiting Oxygen Index (LOI) of 21 or less, additives that increase the LOI of the polymer to greater than 21 can be utilized to raise the LOI of the polymer. Such additives can include compounds such as aluminum polyphosphate (APP), melamine polyphosphate, melamine pyrophosphate, metal phosphinates (e.g. OP-935), and other phosphates.

In some preferred embodiments, the polyacrylonitrile polymer is i) an acrylonitrile homopolymer;

ii) a copolymer of acrylonitrile with vinyl chloride or vinylidene chloride, or any other modacrylic copolymer; or iii) a copolymer of acrylonitrile with vinyl acetate and/or methyl acrylate, and/or styrene sulfonate.

In one especially preferred embodiment, the polyacrylonitrile polymer is a modacrylic polymer, which has a thermal decomposition temperature of about 240-255° C. as defined herein. By modacrylic polymer it is meant preferably the polymer is a copolymer comprising 30 to 70 weight percent of acrylonitrile and 70 to 30 weight percent of a halogen-containing vinyl monomer. The halogen-containing vinyl monomer is at least one monomer selected, for example, from vinyl chloride, vinylidene chloride, vinyl bromide, vinylidene bromide, etc.

In some embodiments the modacrylic copolymers are those of acrylonitrile combined with vinylidene chloride. In some embodiments, the modacrylic copolymer has in addition antimony oxide or antimony oxides. In some preferred embodiments the modacrylic copolymer has either less than 1.5 weight percent antimony oxide or antimony oxides, or the copolymer is totally free of antimony. Very low antimony content polymer and antimony-free polymer can be made by restricting the amount of, or eliminating entirely, any antimony compounds added to the copolymer during manufacture. Representative processes for modacrylic polymers, including those that can be modified in this manner are disclosed in U.S. Pat. No. 3,193,602 having 2 weight percent antimony trioxide; U.S. Pat. No. 3,748,302 made with various antimony oxides that are present in an amount of at least 2 weight percent and preferably not greater than 8 weight percent; and U.S. Pat. No. 5,208,105 & 5,506,042 having 8 to 40 weight percent of an antimony compound.

In some embodiments, within the modacrylic polymer has an LOI of at least 26. In one preferred embodiment the modacrylic polymer has a LOI of at least 26 while also being antimony-free.

In one embodiment, the second polymer is an aramid polymer that has a thermal decomposition temperature of 425° C. or greater as defined herein. The polymer can include polyamide homopolymer, copolymers, or mixtures thereof that are predominantly aromatic, wherein at least 85% of the amide (—CONH—) linkages are attached directly to two aromatic rings. Suitable aramid fibers are described in Man-Made Fibers—Science and Technology, Volume 2, Section titled Fiber-Forming Aromatic Polyamides, page 297, W. Black et al., Interscience Publishers, 1968. Aramid fibers are, also, disclosed in U.S. Pat. Nos. 4,172,938; 3,869,429; 3,819,587; 3,673,143; 3,354,127; and 3,094,511. Additives can be used with the aramid and it has been found that up to as much as 10 percent, by weight, of other polymeric material can be blended with the aramid or that copolymers can be used having as much as 10 percent of other diamine substituted for the diamine of the aramid or as much as 10 percent of other diacid chloride substituted for the diacid chloride or the aramid.

The rings can be unsubstituted or substituted. The polymers are meta-aramid when the two rings or radicals are meta oriented with respect to each other along the molecular chain, and the polymers are para-aramid when the two rings or radicals are para oriented with respect to each other along the molecular chain. Preferably copolymers have no more than 10 percent of other diamines substituted for a primary diamine used in forming the polymer or no more than 10 percent of other diacid chlorides substituted for a primary diacid chloride used in forming the polymer. Additives can be used with the aramid; and it has been found that up to as much as 13 percent by weight of other polymeric material can be blended or bonded with the aramid.

The preferred aramids are meta-aramids, and the preferred meta-aramids are poly(meta-phenylene isophthalamide) (MPD-I) and its copolymers. MPD-I has a Limiting Oxygen Index (LOI) of about 26. These polymers can be polymerized by conventional processes such as disclosed in U.S. Pat. Nos. 3,063,966; 3,227,793; 3,287,324; and 3,414,645.

Inorganic salts that can be used in the present process include chlorides or bromides having cations selected from the group consisting of calcium, lithium, magnesium or aluminum. Calcium chloride or lithium chloride salts are preferred. As used herein, the word "salt" is meant to include the compounds that increase the solubility of the polymer in the selected solvent or help provide stable spinning solutions and excludes any additives (especially flame retardant additives) that might be salts but are only added to increase the limiting oxygen index of the polymer. Likewise, the term "salt-free" does not mean these LOI-increasing additives are not present, only that the inorganic salts mentioned previously are absent.

The salt may be added as the chloride or bromide or produced from the neutralization of by-product acid from the polymerization of the aramid by adding to the polymerization solution oxides or hydroxides of calcium, lithium, magnesium or aluminum. The desired salt concentration may also be achieved by the addition of the halide to a neutralized solution to increase the salt content resulting from neutralization to that desired for spinning. It is possible to use a mixture of salts. The desired salt concentration in the spinning solution can be achieved by (1) neutralization of by-product acid formed in the polymerization reaction, (2) addition of salt to the polymer solution, or some combination of (1) & (2).

In one embodiment, the yarn contains a plurality of filaments wherein each filament has a distinct, continuous, uniform-density sheath that comprises 15 to 85 weight percent of the filament, and a distinct, continuous core that comprises 85 to 15 weight percent of the filament. In some embodiments, the filament core comprises greater than 50 weight percent of the filament. In some embodiments, each filament has a distinct, continuous, uniform-density sheath that comprises 25 weight percent to less than 50 weight percent of the filament, and the distinct, continuous core comprises greater than 50 weight percent to as much as 75 weight percent of the filament.

In one preferred embodiment, the first polymer is a polyacrylonitrile polymer having a thermal decomposition temperature of about 300° C. or less and the second polymer is aramid having a thermal decomposition temperature of 425° C. or greater, which are dry-spun from polymer solutions containing the solvent dimethyl acetamide (DMAc). Further, in this preferred embodiment, the yarn contains a plurality of filaments, wherein each filament has a distinct, continuous, uniform-density sheath of at least 15 weight percent to less than 85 weight percent of polyacrylonitrile and a distinct, continuous core of greater than 15 weight percent to as much as 85 weight percent of aramid polymer, on the basis of these two polymers in each filament. In some embodiments, the filament contains a majority of aramid polymer by weight, on the basis of the two polymers in each filament. In some preferred embodiments, each filament has a distinct, continuous, uniform-density sheath of at least 25 weight percent to less than 50 weight percent of polyacrylonitrile, and a distinct, continuous core of greater than 50 weight percent to as much as 75 weight percent of aramid polymer, on the basis of these two polymers in each filament. In one most preferred embodiment, the polyacrylonitrile polymer is a modacrylic polymer and the aramid polymer is poly(metaphenylene isophthalamide), This invention also relates to a process for forming a yarn comprising filaments, each of the filaments comprising a distinct, continuous uniform-density sheath of a first polymer and a distinct, continuous core of a second polymer, the first polymer having a thermal decomposition temperature at least 50 degrees Celsius lower than the thermal decomposition temperature of the second polymer. In some embodiments the thermal decomposition temperature of the first polymer is at least 75 degrees Celsius lower than the thermal decomposition temperature of the second polymer.

The process comprises the steps of, in order:

a) forming a first polymer solution containing the first polymer in a solvent and a second polymer solution containing the second polymer in the same solvent;

the first polymer solution being salt-free and the second polymer solution including at least 4 percent inorganic salt by weight, based on the amount of the salt, the second polymer, and the solvent in the second solution, to maintain the second polymer in solution; and b) providing a spinneret assembly having separate inlets for the first polymer solution and the second polymer solution and a plurality of exit capillaries for spinning dope filaments;

c) forming a plurality of dope filaments having a sheath of the first polymer solution and a core of the second polymer solution by extruding through the exit capillaries a plurality of conjoined streams of the first and the second solutions into a spin cell, d) contacting the dope filaments with heated gas in the spin cell to remove solvent from the plurality of dope filaments to form reduced solvent filaments, the heated gas having a temperature such that the dope filaments remain below the thermal decomposition temperature of the first polymer in the spin cell;

e) quenching the reduced solvent filaments with an aqueous liquid to cool the filaments, forming a yarn of polymer filaments; and f) further extracting solvent from the yarn of polymer filaments.

In one embodiment the process includes dry-spinning the yarns of sheath-core filaments. In general, the term "dry spinning" means a process for making filaments by extruding a polymer solution in continuous streams through spinneret holes into dope filaments into a heated chamber, known as a spin cell that is provided with a heated gaseous atmosphere. The heated gaseous atmosphere removes a substantial portion of the solvent, generally 40 percent or greater, from the dope filaments leaving semi-solid filaments having enough physical integrity that they can be further processed. This "dry spinning" is distinct from "wet spinning" or "air-gap wet spinning" (also known as air-gap spinning) wherein the polymer solution is extruded in or directly into a liquid bath or coagulating medium to regenerate the polymer filaments. In other words, in dry spinning a gas is the primary initial solvent extraction medium, and in wet spinning (and air-gap wet spinning) a liquid is the primary initial solvent extraction medium. In dry spinning, after sufficient removal of solvent from the dope filaments and the formation of semi-solid filaments, the filaments can then be treated with additional liquids to cool the filaments and possibly extract additional solvent from them. Subsequent washing, drawing, and heat treatments can further extract solvent from the filaments in the yarn.

In a preferred embodiment, in the heated spin cell the dope filaments are contacted or exposed to an environment that contains essentially only inert heated gas and amounts of the solvent removed from the dope filaments. Preferred inert gases are those that are gases at room temperature.

For purposes herein, the term "filament" is defined as a relatively flexible, macroscopically homogeneous body (the body having a sheath and core as previously defined herein) having a high ratio of length to width across its cross-sectional area perpendicular to its length. The body (comprising both sheath and core) is preferably solid or substantially solid to visual inspection under an optical microscope. The filament cross section can be any shape, but is typically a non-round or oblong shape that has been described variously as being bean-shaped, cocoon-shaped, and/or dog-bone-shaped. The term "fiber" can be used interchangeably with "filament" herein. The term "yarn" as used herein is defined as a plurality of filaments.

The process involves forming at least two different polymer solutions, a first polymer solution containing the first polymer in a solvent and a second polymer solution containing the second polymer in the same solvent.

The solvent is preferably selected from the group consisting of those solvents that also function as proton acceptors, for example dimethylforamide (DMF), dimethylacetamide (DMAc), N-methyl-2-pyrrolidone (NMP), and the like. Dimethyl sulfoxide (DMSO) may also be used as a solvent. Dimethylacetamide (DMAc) is one preferred solvent.

The solubility of any particular polymer in any particular solvent is dependent on a variety of parameters, including the relative amounts of polymer and solvent, the molecular weight or inherent viscosity of the polymer, the temperature of the system. Further, while a polymer may be initially soluble in a solvent, with time, the polymer may precipitate out of the solvent, meaning that the solution is not a stable solution.

In a preferred embodiment, the first and second polymer solutions are stable polymer spinning solutions. By "stable polymer spinning solution" it is meant that the polymer is soluble in the solvent or solvent system in a concentration and temperature suitable for spinning fibers, and that the polymer remains soluble in the solvent indefinitely. The term "solvent system" is meant to include a solvent and a solubility/stability aid such as an inorganic salt.

The first polymer forms a stable polymer spinning solution in the solvent only. Therefore the first polymer solution does not need a solubilizing/stabilizing salt and is referred to herein as being salt-free.

The second polymer forms a useful stable polymer spinning solution only if a solubilizing/stabilizing salt is present. Therefore the second polymer solution includes at least 4 percent inorganic salt by weight, based on the amount of the salt, the second polymer, and the solvent in the second solution, to maintain the second polymer in solution. In some embodiments the solution includes at least 7 weight percent inorganic salt.

Useful polymer solutions are those that can be extruded, preferably dry-spun, into useful dope filaments. Parameters that can be balanced to form useful polymer solutions include the polymer molecular weight and concentration of the polymer in the solvent. Obviously, the specific parameters are dependent on the polymer and solvent chosen. However, it is known that certain polymer solutions of a certain viscosity tend to make useful filaments. All of the variables that could impact viscosity, e.g., temperature, concentration, polymer and solvent type, polymer molecular weight, etc. can be used to create a useful polymer solution. Generally such solutions have a so-called zero shear rate or Newtonian viscosity of about 10 to 1000 Pascal seconds (Pa-sec) and preferably about 50 to 500 Pa-sec.

In some embodiments, the first polymer inherently has an LOI of greater than 21, or is provided with additives that increase the LOI of the first polymer to greater than 21. These LOI-increasing additives are typically referred to as flame retardant additives and are normally added when the polymer solution is made, however the polymer itself can be provided with the additive prior to dissolution in the solvent. Both of these methods result in a first polymer solution provided with additives that increase the LOI of the first polymer to greater than 21.

After forming the first and the second solution, the dry spinning process includes providing a spinneret assembly having separate inlets for the first solution and the second solution, and a plurality of exit capillaries for extruding (spinning) dope filaments. One preferred spinneret assembly useful for spinning the dope filaments is disclosed in U.S. Pat. No. 5,505,889 to Davies. However, other spinneret assemblies are potentially useful and can have many different features such as the spinneret assemblies shown in U.S. Pat. Nos. 2,936,482; and 3,541,198, which are just some of the possible spinneret assemblies that can be used.

The process further involves forming a plurality of dope filaments having a continuous sheath of the first polymer solution and at a continuous core of second polymer solution. These filaments are made by extruding through the exit capillaries in the spinneret assembly a plurality of conjoined streams of first and second solutions into a spin cell.

In a preferred embodiment, the first solution and the second solution are supplied via separate inlets to and into the spinneret assembly where they are combined. In some embodiments the spinneret assembly distributes the two solutions such that the two solutions are both supplied to each exit capillary in the spinneret assembly, which forms a bicomponent dope filament. The bicomponent dope filament has a continuous sheath of the first polymer solution and a continuous core of a second polymer solution made by conjoining the first and second polymer solutions in each exit capillary of the spinneret; that is, the solutions are supplied in a manner suitable to provide a sheath-core arrangement and then extruded through the same exit capillary, each exit capillary being one of a plurality of exit capillaries in the spinneret assembly. While this is a preferred embodiment, any other arrangement of exit capillaries or apertures or methods that conjoins the first and second polymer solutions into suitable bicomponent dope filaments of the desired structure can be used.

The process continues with contacting the dope filaments with heated gas in the spin cell to remove solvent from the plurality of dope filaments to form reduced solvent filaments. The heated gas is generally an inert gas like nitrogen. In some embodiments the dope filaments are contacted solely with the heated gas in the spin cell. The heated gas is supplied to the spin cell at a temperature such that the dope filaments remain below the thermal decomposition temperature of the first polymer throughout the spin cell to ensure the first polymer will not degrade during spinning. In some embodiments, this means the heated gas is supplied to the spin cell at a temperature that is below the thermal decomposition temperature of the first polymer.

In some embodiments, of the total solvent in the plurality of dope filaments, as much as 85% of the solvent of the first solution, which comprises the sheath of the filament, is removed in the spin cell, and as much as 50% of the solvent is removed from the second solution, which comprises the core, is also removed in the spin cell, The dope filaments are therefore converted to reduced-solvent filaments in the spin cell. In most embodiments, this means removing differing amounts of solvent on a percentage basis from the sheath and core of the dope filaments in the spin cell.

The reduced-solvent filaments are then quenched with an aqueous liquid to cool the filaments, forming a yarn of polymer filaments. The quench also serves to remove some of the surface tackiness from the filaments for more efficient downstream processing. Further, the quench can remove some additional solvent, and once quenched it is possible that 75 percent or higher of the total original solvent in the dope filaments has been removed.

Additional steps to further extract solvent from the yarn of polymer filaments are then conducted. These steps can include additional washing, drawing, and/or heat treating, as desired.

In one embodiment, the yarns, after the final extraction steps are complete and the desired amount of solvent is removed, contain a plurality of filaments wherein each filament has a distinct, continuous, uniform-density sheath that comprises 15 to 85 weight percent of the filament, and a distinct, continuous core that comprises 85 to 15 weight percent of the filament. In some embodiments, the filament core comprises greater than 50 weight percent of the filament. In some embodiments, each filament has a distinct, continuous, uniform-density sheath that comprises 25 weight percent to less than 50 weight percent of the filament, and the distinct, continuous core comprises greater than 50 weight percent to as much as 75 weight percent of the filament.

Figure 2:
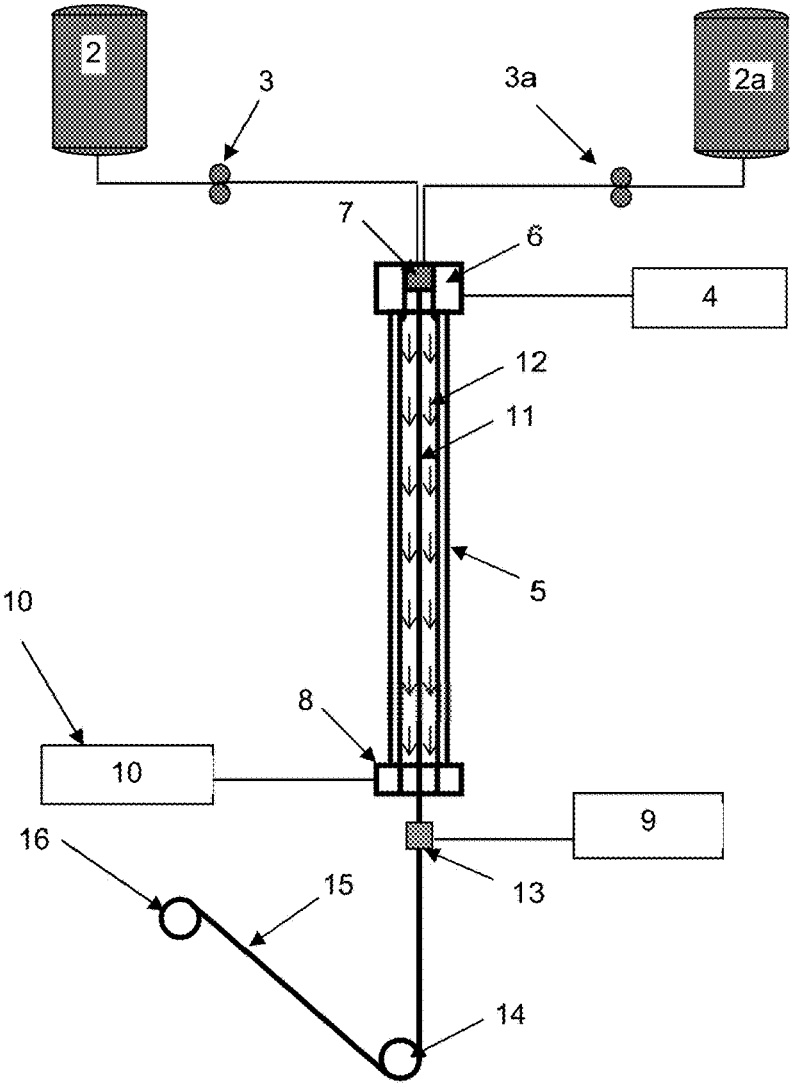
FIG. 2 is a representation of one dry spinning system process suitable for making a yarn of sheath-core filaments.

It has been found that especially useful yarns can be made when the amount of first polymer in the first solution and the amount of second polymer in the second solution are chosen such that after the final extraction steps are complete and the desired amount of solvent is removed, the resulting filaments each have a distinct, continuous, uniform-density sheath of at least 15 weight percent to less than 85 weight percent of polyacrylonitrile and a distinct, continuous core of greater than 15 weight percent to as much as 85 weight percent of aramid polymer, on the basis of these two polymers in each filament. In some embodiments, the filament contains a majority of aramid polymer by weight, on the basis of the two polymers in each filament. In some preferred embodiments, each filament has a distinct, continuous, uniform-density sheath of at least 25 weight percent to less than 50 weight percent of polyacrylonitrile and a distinct, continuous core of greater than 50 weight percent to as much as 75 weight percent of aramid polymer, on the basis of these two polymers in each filament. In one most preferred embodiment, the polyacrylonitrile polymer is a modacrylic polymer and the aramid polymer is poly(metaphenylene isophthalamide), One dry spinning system process suitable for making a yarn having distinct continuous regions of two different polymers is shown in FIG. 2. In this embodiment, two polymer solutions are converted into a multifilament yarn containing filaments having two distinct continuous regions of each polymer in each filament. A first supply 2 of a first polymer solution of a first polymer and a first solvent is conveyed to the dry spinning cell through piping by a motorized pump 3, such as a gear pump made by Zenith, to a spinneret assembly 7. Similarly, a second supply 2*a* of a second polymer solution of a second polymer and a second solvent that can contain a salt (not shown) is conveyed to the dry spinning cell through piping by a motorized pump 3*a*, such as a gear pump made by Zenith, to a spinneret assembly 7.

The spinneret assembly 7 comprises various flow inlets and passages, one or more meter plates and a spinneret having a plurality of exit capillaries and/or apertures that are used to form the desired filament structure. The polymer solutions pass through the spinneret assembly and spinneret and plurality of exit capillaries and/or apertures, forming a threadline 11, which issues from the spinneret face into the spin cell 5 as a plurality of dope filaments.

The spin cell 5 is generally a long tube fabricated from a solid material such as metal, having one or more heat source(s) such as electrical heater(s) along its vertical length. The spinneret assembly is located generally on the centerline of the top of the spin cell. Also at the top of the spin cell is an aspirating area 6 that has passages through which an aspiration gas, such as nitrogen, can be fed through piping from a gas supply system 4 such as a cylinder or other suitable supply system. The aspirating gas enters the aspirating area at the top of the spin cell 5, and flows downward, creating a co-current gas flow 12 down the cell in direct contact with the threadline 11.

The aspirating area 6 has one or more heating source(s), for example electrical heater(s), for heating the aspiration gas. Likewise, the spinneret assembly 7 may be cooled by passing cooling water through tubing wrapped around its perimeter thereby allowing the solution passing through the spinneret assembly 7 to have a lower temperature than the surrounding aspirating area 6. The aspiration gas is further heated by the spin cell heat sources as it traverses the cell by convective contact with the walls of the cell 5. The direct contact of the heated gas flow 12 with the threadline 11 causes evaporation of at least a portion of the solvent from the dope filaments as they traverse from the top to the bottom of the cell. The solvent-laden aspiration gas 12 is then removed from the dry spinning cell at the cell bottom area 8 via piping to a gas exhaust system 10, which typically includes a vacuum generating device.

Without being bound by any limitation of theory of operation, it is believed that although it may be possible to extract all of the solvent from the dope filaments in dry spinning, for many polymers this is not possible, due to a chemical complex that forms between the solvent and the salt; or desirable, due to the length of the spin cell required; and subsequent processing steps are required to remove all the solvent. Therefore, as the threadline exits the spin cell 5 at the cell bottom area 8 the filaments may contain significant quantities of solvent and remain tacky thereby making further handling difficult, especially involving contact with solid surfaces. Therefore the filaments in the threadline after exiting the cell bottom area are quenched through a guide 13 where the filaments makes contact with a continuous flow of a liquid. The quench liquid includes a non-solvent for the polymer system, thereby provoking further precipitation of the polymer from the remaining solvent in the threadline; however, the quench liquid can in addition contain some solvent and salt content. The quenching reduces the temperature of the filaments and further develops the polymer-rich phase at the surface of the filaments. The quench liquid supply system 9 can include the appropriate tanks, piping, and pumps to supply the quench liquid to the quench guide 13.

The individual filament diameters are reduced as the threadline traverses the spin cell, partly as a consequence of solvent loss, but also more significantly by the action of the motorized feed roll 14 over which the threadline travels after quenching. The rotational speed (surface speed) of the feed roll is set such that the threadline speed is higher at the feed roll than the speed of the solution jet that issues dope filaments from the spinneret, therefore attenuating and drawing the threadline in both the spin cell and in quenching. The ratio of the threadline speed at the feed roll to the jet speed at the spinneret is termed the spin stretch, and this is one useful method of controlling the diameter of individual filaments in the quenched threadline 15 after the feed roll. After traversing the feed roll 14 the threadline can be further processed directly or wound onto a bobbin 16 for further processing, such as washing, drawing, and/or heat treating.

In some embodiments the yarns of bicomponent filaments are colored. In some embodiments the continuous sheath of the first polymer is dyed, preferably with basic or cationic dyes. The basic chemical nature of basic dyes is that the dyes ionize with the colored component constituting the cation. Cationic dyes are normally salts, for example, chlorides, oxalates, double salts with zinc chloride, etc.

The yarns contain filaments that are bicomponent wherein the distinct, continuous, uniform-density sheath of the first polymer forms a substantially complete sheath around the distinct continuous core of the second polymer. These sheath-core filaments allow the polymer in the sheath to be dyeable and provide color to the filament regardless of the dyeability of the core.

In one preferred embodiment, a yarn containing these sheath-core filaments, using the preferred polymers, is a yarn having filaments wherein in each filament modacrylic polymer forms a continuous sheath around a core of poly (metaphenylene isophthalamide). The modacrylic polymer is dyeable with basic or cationic dyes. Further, yarns containing these dyed filaments have improved resistance to color change due to ultraviolet (UV) light exposure. Specifically, the change in color (Delta E*) of the yarn is 10 or less after 20 hours of continuous UV light exposure to an Xenon arc lamp.

Test Methods

The thermal decomposition temperature of the polymers was determined by a thermo-gravimetric analyzer (TGA) equipped with an a Fourier transfer infrared (FTIR) spectrometer to analyze the composition of gases evolved from the sample as it was heated from room temperature to greater than 500° C. at a heating rate of 10° C./min. The thermal decomposition temperature is the temperature at which a weight loss of the polymer of at least 10% is initiated by inspection of the scan or by software provided with the analyzer that provides a temperature at which a certain weight loss occurs. This is weight lost due to actual thermal decomposition of the polymer, not elimination of, for example water. The TGA determines the decomposition temperature and the FTIR confirms that the weight loss is associated with decomposition products and not water or solvent. FIGS. 3, 4, & 5 are illustrations of TGA scans.

The limited oxygen index (LOI) of the polymer is measured on a sample of the polymer in film form and determined by techniques such as specified in ASTM D2863.

The mechanical properties of the yarns (tenacity/modulus/elongation) are determined by techniques such as specified in ASTM D885.

Colorfastness to Light of the fiber was tested following AATCC Test Method 16-2004—Option 3 (Xenon arc lamp, continuous light, black panel option) with 20 hours of UV exposure. The system used for measuring color is a 1976 CIELAB color scale (L-a-b system developed by the Commission Internationale de I'Eclairage). In the CIE "L*-a*-b*" system, color is viewed as point in three dimensional space. The "L*" value is the lightness coordinate with high values being the lightest, the "a*" value is the red/green coordinate with "+a*" indicating red hue and "−a*" indicating green hue and the "b*" value is the yellow/blue coordinate with "+b*" indicating yellow hue and "−b*" indicating blue hue. All samples were measured using a spectrophotometer under the following viewing conditions; D65 illuminant, 10° observer, specular included. The total color difference, Delta E ($\Delta E_{CIELAB}$), of exposed samples vs non-exposed samples was calculated using the CIE 1976 (L*a*b*) color difference equation.

Example 1

A small quantity of a poly(acrylonitrile-co-vinyl chloride), also known as modacrylic polymer was tested in a thermogravimetric analyzer (TGA) equipped with an a Fourier transfer infrared (FTIR) spectrometer to analyze the composition of gases evolved from the sample as it was heated from room temperature to greater than 500° C. at a heating rate of 10° C./min. As shown in FIG. 3 significant weight loss was seen starting at about 253° C. which is deemed to be the thermal decomposition temperature for this polymer. The FTIR spectrometer showed that gas evolved comprised HCl and HCN. This analysis demonstrated the desirability of maintaining temperatures below 253° C. when processing the modacrylic polymer.

A similar scan (FIG. 4) is conducted on poly(metaphenylene isophthalamide) and the thermal decomposition temperature was deemed to be about 433° C.

Example 2

Figure 6:
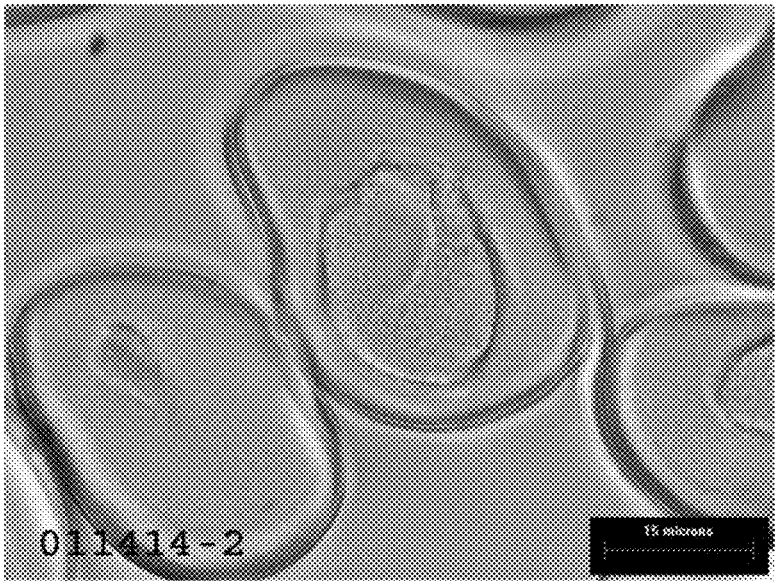
FIG. 6 is an optical microscope image of the cross section of the homopolymer poly(metaphenylene isophthalamide) filaments that do not have solid dense centers and have considerable central porosity.

This examples illustrates the negative effect on filament quality that spin cell gas temperature has on filament formation when making a yarn comprising filaments of one polymer, that being poly(metaphenylene isophthalamide) (MPD-I), via dry spinning. FIG. 4 is a TGA scan of MPD-I wherein the decomposition temperature was determined to be in excess of 425° C. (433° C.). Dope filaments of a MPD-I polymer solution consisting of 19.3 wt % MPD-I solids, 70 wt % DMAc solvent and 9 wt % calcium chloride salt were extruded through a spinneret having four holes, each with a diameter of 0.005 inches and a length of 0.01 inches into an electrically heated spin cell. The spinneret assembly was provided with water cooling passages such that the temperature of the solutions as they traveled through the meter plate and spinneret were held at approximately 60° C. The spin cell was fabricated from a metal tube approximately 4' long and with an inside diameter of 4". Nitrogen supplied at a flow rate of 17 standard liters per minute and heated to 230° C. was used as the aspiration gas. The extrusion of dope filaments into the dry gas in the heated tube removed solvent from the spun dope filaments in the spin cell. After exiting the spin cell, the reduced solvent filaments were then quenched with an aqueous liquid to cool and further coagulate the filaments. A sample of the threadline produced from this process is taken after the feed roll and a photomicrograph cross section of the single component filaments was taken. As shown in a FIG. 6, inspection of the cross section of these filaments shows that the filaments do not have solid dense centers and have considerable central porosity. The fibers are oval shaped often typical of dry spinning.

Example 3

Figure 7:
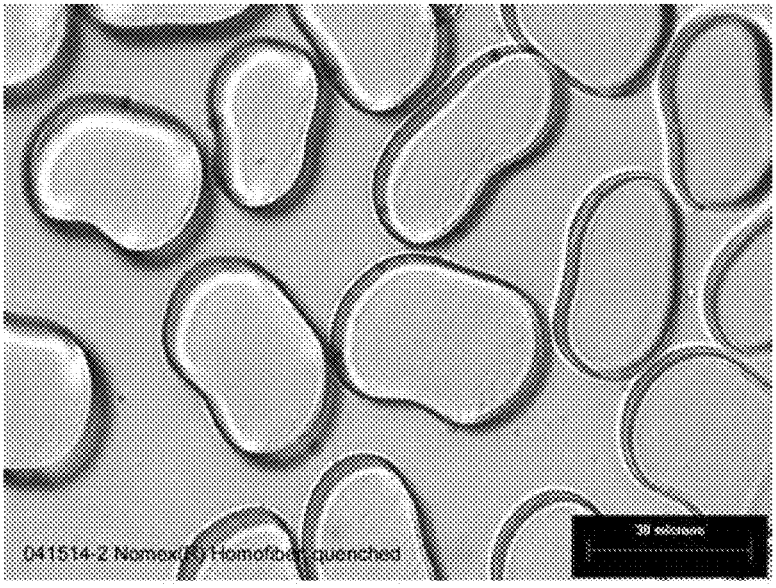
FIG. 7 is an optical microscope image of the cross section of the homopolymer poly(metaphenylene isophthalamide) filaments having solid dense centers.

This example illustrates a typical prior art process for making a yarn comprising filaments of one polymer, that being poly(metaphenylene isophthalamide) (MPD-I), via dry spinning. Example 2 is repeated except the nitrogen aspiration gas supplied to the spin cell is heated to 300° C. As shown by FIG. 7, inspection of a filament cross section shows the filaments are oval shaped and free of central or radial visible occlusions, indicating good fibers have solid, dense centers free of undesired central porosity without radial cracks.

Example 4

This is an example of a yarn comprising a plurality of dry-spun filaments having a distinct continuous region of modacrylic as a first polymer and a distinct continuous region of a MPD-I as a second polymer, A 35 wt % polymer solution of the modacrylic polymer of Example 1, dissolved in DMAc was placed in tank 2*a* of the apparatus of FIG. 2 and a 19.3 wt % solution of MPD-I polymer in DMAc containing 9 wt % calcium chloride was placed in tank 2. The apparatus of FIG. 2 was then used to spin sheath-core bicomponent fibers from these two solutions into the same spin cell as Example 2. In the bicomponent filaments the modacrylic polymer was the sheath and the MPD-I polymer the core. As in Example 2, nitrogen supplied at a flow rate of 17 standard liters per minute and heated to 230° C. was used as the aspiration gas; and after exiting the spin cell, the reduced solvent filaments were then quenched with an aqueous liquid to cool and further coagulate the filaments.

The spinneret assembly comprises an appropriately designed meter plate and spinneret to produce the desired sheath core structure from the two solutions, for example such as shown in FIGS. 1-3 of U.S. Pat. No. 5,505,889 to Davies. The spinneret further comprised four holes, each with a diameter of 0.005 inches and a length of 0.01 inches. The spinneret assembly further comprised water cooling passages such that the temperature of the solutions as they traveled through the meter plate and spinneret were held at approximately 60° C.

The modacrylic solution was fed to the spinneret assembly at a flow rate of 0.03 gm polymer/min/hole. The MPD-I solution was fed to the spinneret assembly at a flow rate of 0.05 gm polymer/min/hole. These flow rates were selected to give a nominal 35 wt % modacrylic sheath and a 65 wt % MPD-I core after all solvent and calcium chloride was removed from the dope filaments. The feed roll surface speed was approximately 100 yards/min resulting in a spin stretch of 3.7. A sample of the threadline produced from this process was taken from the feed roll and an optical microscope image of the cross section of the sheath-core bicomponent filaments was taken and shown in FIG. 1. The sheath core structure of the fiber is apparent. Inspection of the filament cross section shows the filaments to have solid dense centers and to be free of objectionable porosity and the fibers are oval shaped.

Example 5

Yarns of modacrylic sheath/MPD-I core bicomponent filaments spun using the process Example 4 were subsequently processed in a second operation in which the yarn was fed through a first tank containing 30 wt % DMAc in water at room temperature and drawn 3.5× while submerged. The yarn was then fed through three consecutive tanks, each filled with water at room temperature, to remove solvent and calcium chloride. The yarn was than continuously processed through a tube oven held at 150° C. through which a stream of nitrogen also heated to 150° C. was passed in contact with the yarn filaments and traveling countercurrent to the direction of the yarn. The dried yarn was then wound on cardboard tubes.

Each filament in the yarn had a linear density of 2.05 denier. The four-filament yarn had a tenacity of 3.21 grams per denier, an elongation at break of 38.3%, and a tensile modulus of 105 grams per denier.

Example 6

The dyeability of the drawn, washed and dried yarn of Example 5 was evaluated as follows. Approximately 1 gram of modacrylic/MPD-I bicomponent yarn of Example 5 was placed in a nylon bag. As a control, 1 gram of 100% MPD-I fiber was placed in a second nylon bag. Both bags were placed in a dye pot containing 500 ml of water, 15 gm/liter of Cindye C-45, a carrier known to facilitate the dyeing of aramid fibers, and 3 wt % of Basic Red 29 dye. The dye pot was heated and held at 100° C. for 30 minutes.

Both yarn samples were then removed from the pot and rinsed with water and dried in an oven at 85° C. Visually, the modacrylic/MPD-I bicomponent fiber dyed to a deep shade of red while the control was only lightly tinted. To quantify this difference, the samples were tested on a Hunter spectrophotometer to determine the "L" value, or lightness, per the Hunter color scale. A low value on the scale indicates a dark shade, while a high value indicates a light shade. The modacrylic/MPD-I bicomponent yarn had an "L" value of 43.1 versus an "L" value of 70.6 for the control yarn, indicating the good dyeability of the bicomponent yarn.

Example 7

Example 4 was repeated but with a different first polymer. In this example, a solution comprising 19 wt % poly (acrylonitrile-co-methyl acrylate) copolymer and 2.3 wt % melamine pyrophosphate (MPP) in DMAc replaced the modacrylic polymer solution. The decomposition temperature of poly(acrylonitrile-co-methyl acrylate) was found to be 356° C. as by measured TGA, which is shown in FIG. 5. The poly(acrylonitrile-co-methyl acrylate) is not inherently flame resistant, so flame retardant particulate MPP was added to impart flame resistance to the sheath. The nitrogen supplied was heated to 250° C., but otherwise all other spin cell conditions remained the same.

The acrylic copolymer/MPP solution was fed to the spinneret assembly at a flow rate of 0.013 gm solids/min/hole. The MPD-I solution was fed to the spinning at a flow rate of 0.068 gm polymer/min/hole. These flow rates were selected to give a nominal 15 wt % acrylic/MPP sheath and an 85 wt % MPD-I core after all solvent and calcium chloride was removed in processing downstream of the spin cell. The sheath alone was comprised of 89% acrylic copolymer and 11% MPP. The feed roll 14 surface speed was approximately 100 yards/min resulting in a spin stretch of 3.0.

Figure 8:
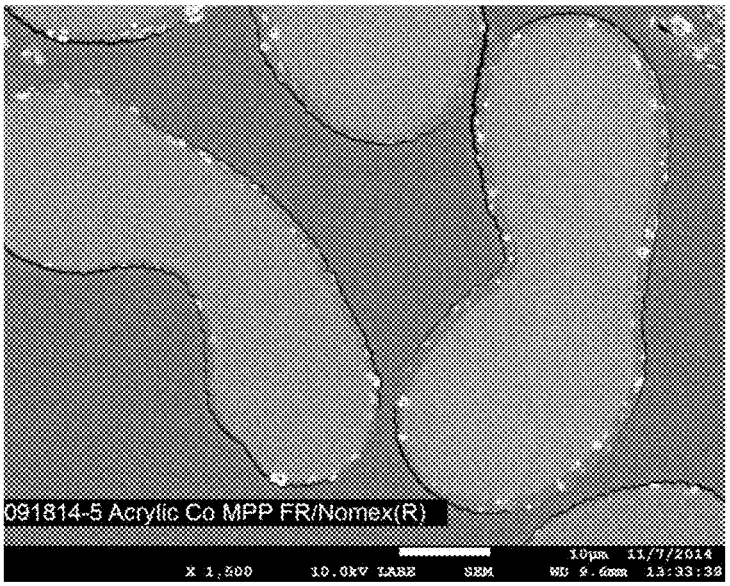
FIG. 8 is scanning electron microscope image of the cross section of the high quality sheath-core bicomponent filaments and solid dense centers, showing the presence of flame retardant particles in the sheath.

A sample of the threadline produced from this process was taken from the feed roll and a scanning electron microscope image of the cross section of the sheath-core bicomponent filaments was taken and shown in FIG. 8. The sheath core structure of the fiber is apparent. Inspection of the filament cross section shows the filaments to have solid dense centers and to be free of objectionable porosity and the fibers are oval shaped. Further inspection of the image shows the presence of the MPP particles appearing as white specs in the image of the sheath which energy dispersive x-ray spectroscopy further confirms to be phosphorus containing particles.

Example 8

Yarns of acrylic copolymer/MPP sheath/MPD-I core bicomponent filaments spun using the process Example 7 were subsequently processed in a second operation in which the yarn was fed through a first tank containing 30 wt % DMAc in water at room temperature and drawn 4× while submerged. The yarn was then fed through a second tank filled with water at room temperature, to remove solvent and calcium chloride. The yarn was than continuously processed through a tube oven held at 200° C. through which a stream of nitrogen also heated to 200° C. was passed in contact with the yarn filaments and traveling countercurrent to the direction of the yarn. The dried yarn was then wound on cardboard tubes.

Each filament in the yarn had a linear density of 2.18 denier. The four-filament yarn had a tenacity of 4.26 grams per denier, an elongation at break of 45.1%, and a tensile modulus of 82 grams per denier.

What is claimed is:

1. A yarn comprising a plurality of filaments, each of the filaments having a distinct, continuous, uniform-density sheath of a first polymer and a distinct, continuous core of a second polymer, with the sheath surrounding the core;

wherein the filaments are made by extruding a first polymer solution comprising the first polymer in a solvent with a second polymer solution comprising the second polymer in the same solvent; and additionally, the first polymer solution being salt-free and the second polymer solution including at least 4 percent inorganic salt by weight, based on the amount of the salt, the second polymer and the solvent in the second solution;

wherein the first polymer is a polyacrylonitrile polymer and the second polymer is an aramid polymer, the polyacrylonitrile polymer being either a copolymer consisting of acrylonitrile and vinyl chloride, or a copolymer consisting of acrylonitrile and vinylidene chloride;

wherein the polyacrylonitrile polymer has a limiting oxygen index of greater than 21, or is provided with additives that increase the limiting oxygen index of the polyacrylonitrile polymer to a value of greater than 21, and the aramid polymer has an LOI of greater than 24, the polyacrylonitrile polymer further having a thermal decomposition temperature at least 50 degrees Celsius lower than the thermal decomposition temperature of the aramid polymer, wherein the inorganic salt is a chloride or bromide of calcium, lithium, magnesium or aluminum, wherein the continuous core has a solid cross section, and wherein the filament contains greater than 50 weight percent to 85 weight percent aramid polymer, based on the weight of the aramid polymer and the polyacrylonitrile polymer in each filament.

2. The yarn of claim 1 wherein the thermal decomposition temperature of the polyacrylonitrile polymer is at least 75 degrees Celsius lower than the thermal decomposition temperature of the second polymer.

3. The yarn of claim 1 wherein the aramid is poly (metaphenylene isophthalamide).

4. The yarn of claim 1 made by dry spinning the filaments.

5. The yarn of claim 1 wherein the first polymer sheath includes a dye or pigment to color the yarn.

6. The yarn of claim 5 wherein the yarn has a change in color (Delta E*) of 10 or less after 20 hours of ultraviolet light exposure.

7. A process for forming a yarn comprising filaments, each of the filaments comprising a distinct, continuous uniform-density sheath of a first polymer and a distinct, continuous core of a second polymer, with the sheath surrounding the core;

wherein the first polymer is a polyacrylonitrile polymer and the second polymer is an aramid polymer, the polyacrylonitrile polymer being either a copolymer consisting of acrylonitrile and vinyl chloride, or a copolymer consisting of acrylonitrile and vinylidene chloride;

wherein the polyacrylonitrile polymer has a limiting oxygen index of greater than 21, or is provided with additives that increase the limiting oxygen index of the polyacrylonitrile polymer to a value of greater than 21, and the aramid polymer has an LOI of greater than 24, the polyacrylonitrile polymer having a thermal decomposition temperature at least 50 degrees Celsius lower than a thermal decomposition temperature of the aramid polymer, the process comprising the steps of:

a) forming a first polymer solution comprising the first polymer in a solvent and a second polymer solution comprising the second polymer in the same solvent;

the first polymer solution being salt-free and the second polymer solution including at least 4 percent inorganic salt by weight, based on the amount of the salt, the second polymer and the solvent in the second solution, wherein the inorganic salt is a chloride or bromide of calcium, lithium, magnesium or aluminum;

b) providing a spinneret assembly having separate inlets for the first polymer solution and the second polymer solution and a plurality of exit capillaries for spinning dope filaments;

c) forming a plurality of dope filaments having a sheath of the first polymer solution and a core of the second polymer solution by extruding through the exit capillaries a plurality of conjoined streams of the first polymer solution and the second polymer solution into a spin cell, d) contacting the dope filaments with heated gas in the spin cell to remove solvent from the dope filaments to form reduced solvent filaments, the heated gas having a temperature such that the dope filaments remain below the thermal decomposition temperature of the first polymer in the spin cell;

e) quenching the reduced solvent filaments with an aqueous liquid to cool the filaments, forming a yarn of polymer filaments; and f) further extracting solvent from the yarn of polymer filaments, wherein the continuous core has a solid cross section, and wherein the filament contains greater than 50 weight percent to 85 weight percent aramid polymer, based on the weight of the aramid polymer and the polyacrylonitrile polymer in each filament.

8. The process of claim 7 wherein the thermal decomposition temperature of the polyacrylonitrile polymer is at least 75 degrees Celsius lower than the thermal decomposition temperature of the aramid polymer.

9. The process of claim 7 wherein the first solution and the second solution are combined in the spinneret assembly and then extruded into sheath-core dope filaments through each exit capillary of the plurality of exit capillaries.

10. The process of claim 7 wherein the plurality of exit capillaries in the spinneret includes a plurality of first apertures and a plurality of second apertures; the first solution being spun through the plurality of first apertures and the second solution being spun through the plurality of second apertures to form a plurality of sheath-core dope filaments.

11. The process of claim 7 wherein the aramid is poly (metaphenylene isophthalamide).

* * * * *